US008876220B2

(12) United States Patent
In't Hout et al.

(10) Patent No.: US 8,876,220 B2
(45) Date of Patent: Nov. 4, 2014

(54) SEGMENTS AND APPARATUS FOR HIGH WALL MINING INCLUDING FLUID FEED

(75) Inventors: Cornelis Wilhelm In't Hout, Dordrecht (NL); Robert Th. Stein, Vught (NL)

(73) Assignee: Caterpillar Global Mining Highwall Miners LLC, Beckley, WV (US)

( * ) Notice: Subject to any disclaimer, the term of this patent is extended or adjusted under 35 U.S.C. 154(b) by 159 days.

(21) Appl. No.: 13/497,285

(22) PCT Filed: Sep. 29, 2009

(86) PCT No.: PCT/NL2009/050583

§ 371 (c)(1),
(2), (4) Date: May 4, 2012

(87) PCT Pub. No.: WO2011/040806

PCT Pub. Date: Apr. 7, 2011

(65) Prior Publication Data

US 2012/0205964 A1 Aug. 16, 2012

(51) Int. Cl.

| | |
|---|---|
| ***E21C 27/00*** | (2006.01) |
| ***E21C 35/20*** | (2006.01) |
| ***E21F 13/08*** | (2006.01) |
| *E21C 35/24* | (2006.01) |

(52) U.S. Cl.

CPC ..... *E21F 13/083* (2013.01); *E21C 35/20* (2013.01); *E21C 35/24* (2013.01); *E21C 27/00* (2013.01)

USPC ..... 299/64; 299/30; 299/67; 299/68; 299/18

(58) Field of Classification Search

USPC ..... 299/18, 30, 31, 55, 56, 58, 64, 65, 67, 299/68; 198/735.2–735.6

See application file for complete search history.

(56) References Cited

U.S. PATENT DOCUMENTS

| | | | | |
|---|---|---|---|---|
| 4,014,574 | A * | 3/1977 | Todd | 299/1.4 |
| 4,288,125 | A * | 9/1981 | Ingle | 299/30 |
| 4,494,617 | A * | 1/1985 | Snyder | 175/86 |
| 4,952,000 | A | 8/1990 | Lipinski et al. | |
| 4,953,915 | A * | 9/1990 | Jasser et al. | 299/18 |
| 5,609,397 | A | 3/1997 | Marshall et al. | |
| 5,692,807 | A * | 12/1997 | Zimmerman | 299/67 |

(Continued)

FOREIGN PATENT DOCUMENTS

| | | |
|---|---|---|
| GB | 2 093 123 A | 8/1982 |
| WO | 2006/052123 | 5/2006 |

OTHER PUBLICATIONS

International Search Report for corresponding International Application No. PCT/NL2009/050583 mailed Jun. 7, 2010.

(Continued)

*Primary Examiner* — David Bagnell
*Assistant Examiner* — Michael Goodwin
(74) *Attorney, Agent, or Firm* — Foley & Lardner LLP

(57) ABSTRACT

A cutter head segment for use at the front of a train of conveyor segments for high wall mining includes at least one fluid transporter connected to a fluid distribution chamber. A pump segment for use in a train of conveyor segments for high wall mining as a segment following the cutter head segment is provided with a second fluid transporter and at least one front connector and at least one rear connector for connecting the second fluid transporter to adjacent fluid transporters. An assembly includes a cutter head segment and a pump segment, and a train of conveyor segments.

20 Claims, 7 Drawing Sheets

(56) References Cited

U.S. PATENT DOCUMENTS

| | | | | |
|---|---|---|---|---|
| 5,997,100 | A * | 12/1999 | Marshall et al. | 299/12 |
| 6,220,670 | B1 * | 4/2001 | Mraz | 299/18 |
| 6,364,418 | B1 * | 4/2002 | Schwoebel | 299/17 |
| 2003/0042784 | A1 * | 3/2003 | Chisholm | 299/30 |
| 2004/0245843 | A1 * | 12/2004 | Lowery | 299/30 |

OTHER PUBLICATIONS

Written Opinion for corresponding International Application No. PCT/NL2009/050583 mailed Jun. 7, 2010.

* cited by examiner

SEGMENTS AND APPARATUS FOR HIGH WALL MINING INCLUDING FLUID FEED

This application is a national phase of International Application No. PCT/NL2009/050583 filed Sep. 29, 2009 and published in the English language.

TECHNICAL FIELD

The invention relates to a cutter head segment for use at the front of a train of conveyor segments for high wall mining. The invention further relates to a pump segment for use in a train of conveyor segments for high wall mining which pump segment follows the cutter head segment. Moreover, the invention relates to an assembly of a cutter head segment and a pump segment as well as to a train of conveyor segments for high wall mining. Further, the invention relates to a high wall mining apparatus and to a method for high wall mining.

BACKGROUND

High wall mining is applied in harvesting coal, minerals, ores or other materials in seams or veins under an overburden, which may be accessed from an exposed edge of the seam or vein. High wall mining is applicable where the appropriate machinery can be placed in a cut or trench to extend a cutter head, followed by a train of conveyor segments (or units) as the cutter head advances, into a substantially horizontal shaft under the overburden. Usually a train of segments for high wall mining comprises a cutter head, a train of conveyor segments, provided with a conveyor for transporting mined material from and to opposite adjacent conveyor segments in the train of conveyor segments and a drive for the cutter head and conveyors. A known train of segments for high wall mining is described in WO 2006/052123.

In specific circumstances, environmental conditions in the mining area near or at the cutter head can hamper efficient mining. For example, a fluid such as water may flow from the environment into the mining shaft flooding the cutter head, wherein the fluid inflow can typical be as high as 15-20 liters per second or even higher. This will not only decrease the mining capacity due to increased inefficiency (e.g., as the fluid is also to be transported by the conveyors at the expense of mined material), but it may also cause damage to parts of the mining equipment like cutter drives, gathering motors, gear boxes, and gathering arms.

SUMMARY

The present invention aims to provide a solution for high wall mining, which allows for efficient and reliable mining in the circumstance that a fluid such as water flows into the mining shaft.

The invention provides thereto a cutter head segment for use at the front of a train of conveyor segments for high wall mining, comprising: a frame, at least one cutter head, connected to the front side of the frame, which cutter head is provided with a drive for the cutter head, at least one coupling element, connected to the frame at a backside opposite to the front side, for coupling the cutter head segment with a subsequent segment of the train of conveyor segments and at least one first fluid transporter connecting to at least one fluid distribution chamber which distribution chamber is opened to the environment. Using such a cutter head segment allows for transporting media towards and/or away from the cutter head. If for example an excess of a liquid such as water flows into the mining shaft near the cutter head, the liquid can be transported away from the cutter head segment via the distribution chamber and the fluid transporter. As a result mined material can be transported to the entrance of the mining shaft, without an excess of liquid, thereby optimising the use of the transport capacity of mined material and preventing damage to the mining equipment.

In this context by fluid is meant among others liquids such as water, oil, solutions, dispersions, emulsions, suspensions, gases and mixtures of such. The cutter head segment according to the invention also allows transporting fluid towards the cutter head. In case of the release of unwanted gases, such as flammable gases, towards the direct mining area near or at the cutter head, neutralization gases may be transported through the first fluid transporter to decrease the chance of unwanted situation, such as explosions. Preferably, the fluid distribution chamber extends in the width direction of the cutter head segment, which further increases the transport capacity.

The first fluid transporter can be designed in various ways. Preferably the first fluid transporter comprises at least one pipe. The pipe may have a round cross-section, or any other shape as to be designed in a compact way, as to fit into desired dimensions for easy advancing the cutter head segment into the mining shaft. The first fluid transporter may be made of various materials. Preferably the first fluid transporter is at least partly made from steel, which provides the first fluid transporter sufficient strength.

In another preferred embodiment, the fluid distribution chamber is opened to the environment with an intermediate strainer, for preventing objects greater than a predetermined size entering the fluid transporter. This prevents unwanted obstruction of the first fluid transporter by objects, especially mined material. The grid of the strainer can be chosen dependent on the specific mining and material conditions as well as on the fluid transporter characteristics, such as the dimensions of a cross-section of the fluid transporter. As an example, the grid of the strainer is dimensioned such that it prevents objects entering the first fluid transporter fitting through a rectangular grid of approximately 20×20 or 25×25 mm.

The cutter head segment may be designed in various ways. Preferably, the cutter head segment comprises an equipment chamber, whereby the distribution chamber is located below such equipment chamber. The lower positioning of the distribution chamber keeps the equipment chamber at least partially dry and maintains lower liquid levels in the mining shaft near the cutter head. A lower liquid level in the equipment chamber will likely result in less damage to the equipment, such as gathering arms, transmissions et cetera installed in the equipment chamber.

In another embodiment the first fluid transporter is provided with at least one flexible coupling. As the cutter head is movably connected to the frame, it allows adjusting the orientation of the first fluid transporter in relation to the advancing direction of the cutter head. Preferably, the first fluid transporter (firmly connected to the frame) is hingedly connected to the distribution chamber (which in turn may be firmly connected to the equipment chamber). In this configuration, both the first fluid transporter and the equipment chamber are able to follow the direction of movement of the cutter head without being extremely vulnerable, in accordance with the rotatable freedom of movement of the frame and the equipment chamber.

It is advantageous to provide the cutter head segment with at least one sensor for detecting fluid. The signal obtained by the fluid sensor may be used for controlling the fluid transport. If for example the sensor detects that the liquid level is above a predetermined level, fluid flow away from the cutter head may be increased. Preferably, the fluid sensor is at least partly covered by a housing. This provides increased reliability, as the housing prevents damage to the fluid sensor. The fluid sensor may be designed in various ways. Preferably the fluid sensor comprises a pressure sensor for detecting a liquid level, as it measures the pressure of a column of liquid. The pressure can thus be used for calculating the liquid level. The fluid sensor may also comprise a gas sensor, for detecting specific gas types. The signal provided by the gas sensor may be used for transporting a neutralization fluid (liquids and or gasses) towards the cutter head segment. The cutter head segment may also be provided with at least one liquid sensor, such as a liquid level sensor, together with a gas sensor.

The invention also provides a pump segment for use as a following segment in a train of conveyor segments for high wall mining following a cutter head segment according to the invention, comprising: a housing, at least one conveyor connected to the housing for transporting mined material between opposite sides of the pump segment, a second fluid transporter connected to the housing for transporting fluid between opposite sides of the pump segment, incorporating at least one pump and at least one front connector and at least one rear connector for connecting the second fluid transporter to adjacent fluid transporters. The pump segment according to the invention can advantageously be used in cooperation with the cutter head segment according to the invention. Although it is not excluded that the cutter head segment comprises a driving element for the transport of fluid, such as a pump, it is advantageous to provide a separate pump segment, for driving fluid away and/or to the cutter head segment. This makes the train of conveyor segments for high wall mining more flexible in use and allows for easy and quicker replacement in case of damage to either the cutter head segment or the pump segment. A further reason for providing separate cutter head and pump segments is that this enables the use of larger additional parts; the available space for all additional parts (e.g. distribution chambers, pumps, swiveling connections and so on) in a single segment is very limited, this limitation is taken away with the use of separate cutter head and pump segments.

In a preferred embodiment, the pump of the pump segment is two-directional. Such a pump allows for transporting fluid towards and away from the cutter head. This may be advantageous in case in addition to draining liquid from the mining shaft it is also required to transport fluid towards the cutter head, such as explained above in the case of unwanted (e.g. explosive) gases flowing in the mining shaft. A further option is to transport a fluid, such as a liquid, towards the opening of the fluid distribution chamber at the cutter head in case a fluid transporter is obstructed. The fluid flow thus allows for unclogging of the fluid transporter. The fluid may de transported in the direction of the cutter head temporarily only once or frequently by reversing the pumping-direction. Preferably, the pump is a metering pump, which allows for quick and dosed transport of fluid.

Different types of pumps may be used for driving the fluid through the fluid transporters. Preferably the pump is a cavity pump. This type of pump transfers fluid by means of the progress, through the pump, of a sequence of small cavities by a turning rotor. This leads to the volumetric flow rate being proportional to the rotation rate (two-directionally) and to low levels of shearing being applied to the pumped fluid. Hence these pumps can be used in fluid metering and pumping of viscous or shear sensitive materials. The cavities may taper down toward their ends and overlap with their neighboring cavities, so that no flow pulsing or less flow pulsing is caused by the arrival of cavities, each cavity called a stage and each neighboring stage adding to the delta pressure upward at the outlet, other than that caused by compression of the fluid or pump components. The pump may be provided with a stator manufactured from rubber, which as a lubricant film takes up for example water based mud (sludge) from the mined material and/or graphite by mined coal) out of the fluid to be transported away from the cutter head. As a result, the lubricant film prevents dry-running of the pump. Preferably, the pump is designed as to provide a pumping pressure up to at least 8 bar.

In yet another embodiment, the second fluid transporter comprises two separate passages, which passages at a first side are provided with two spaced apart front connectors, and at the opposite side of the passages with two rear connectors at a smaller distance than the front connectors. In case of decreased capacity or even damage of a first passage of the second fluid transporter, for example as a result of a leak or a blocking by objects, fluid flow capacity is still available through the other passage of the second fluid transporter and the mining of material may be continued. The two separate passages also provide the possibility to transport fluid such as a gas towards the cutter head segment and to transport liquid, such as water, away from the cutter head (e.g. simultaneously). Another important advantage of dual passages is that when only a limited liquid flow is required sediment that is carried along with the liquid will not deposit when only one passage is used; the flow in that single operating passage will in such a situation still be sufficient to carry the sediment along. Such situation that only a single passage is used will normally arise during mining; a still substantial part of water entering the mining shaft will be removed together with the mined material. However, when the mining stops, the water will still enter the mining shaft with the same speed; thus stopping the mining activity requires additional capacity in removing water from the shaft in such situation. The second passage will then be utilized to remove the water.

The rear connectors allow for coupling an adjacent fluid transporter at the rear of the passages of the second fluid transporter at a single location or at locations spaced apart at a closer distance than the front connectors of the passages. As a result the train of conveyor segments for high wall mining can be more easily assembled and disassembled. Preferably, the rear connectors are designed to connect an adjacent fluid transporter made of a single unit to the rear of the passages, which further simplifies the assembly or disassembly of the train of conveyor segments for high wall mining.

In another embodiment one passage of the second fluid transporter incorporates a fly-over between longitudinal sides of the pump segment. This allows for combining two passages (pipes, lines) with the rear of the passage at a single longitudinal side of the pump segment, which allows for combining dual passages in a single transport line and results in easy assembly and disassembly of the train of conveyor segments for high wall mining, easy rolling and unrolling of a single transport line with dual passages.

The second fluid transporter is primarily adjusted for transporting fluid to and/or away from the cutter head. It may also be that the second fluid transporter is provided with additional channels, cables, wires, lines etcetera. In a preferred embodiment the rear connector also comprises at least one data connector for coupling a signal line. The signal line may be provided with one or more communication lines for communication with the drive of the cutter head, the pump, the fluid sensor etcetera. The additional channel may also comprise a power supply, such as a hydraulic and/or electrical power line for the cutter head, the pump or other driven equipment parts.

An embodiment of the invention moreover provides an assembly, comprising a cutter head segment and a pump segment as disclosed above, wherein the pump segment is coupled with the cutter head segment such that the first fluid transporter connects to the second fluid transporter. The advantages of the assembly correspond to the advantages as described above in relation to the cutter head segment and the pump segment.

A steering signal for the pump may be provided from outside the mine shaft. Preferably, the cutter head segment comprises at least one fluid sensor that is communicating with the pump, for steering the pump. In case of a direct communication this simplifies the communication between the fluid sensor and the pump, since activation of the pump is predominantly determined by the presence of a fluid and in particular the liquid level near or at the cutter head.

An embodiment of the invention also provides a train of conveyor segments for high wall mining, comprising an assembly as disclosed above and a number of conveyor segments, coupled subsequent to the pump segment. The advantages of the train of conveyor segments for high wall mining correspond to the advantages as described above in relation to the assembly of the cutter head segment and the pump segment. Conveyor segments are known per se and are usually provided with: a conveyor for transporting mined material from and to opposite adjacent conveyor segments in the train of conveyor segments, a transmission for transmitting power from and/or to opposite adjacent segments in the train of conveyor segments and for transmitting power to a second driving element for the at least one conveyor, at least one coupling element at each of the opposite sides of the conveyor segment for coupling the conveyor segment with opposite adjacent segments of the train of conveyor segments.

In addition, the train of conveyor segments for high wall mining may be provided with a flexible feed, for connection to the rear connectors of the passages of the second fluid transporter of the pump segment. Preferably, the feed comprises one or more channels with a diameter about 90 mm and is preferably formed as a tube made from polyethylene. Depending on the mining conditions, the length of the flexible feed may be up to 350 meter or longer. As mentioned before in relation to the first and second fluid transporters the feed is preferably provided with dual passages; thus incorporating two parallel tubes. These tubes may be joined together with one or more other (signal) lines, feeder cables and/or hydraulic feeds.

A various number of conveyor segments may be positioned in between the pump segment and the cutter head segment of the train of conveyor segments for high wall mining. Care has to be taken that the vapor capacity of the pump is sufficient to remove the liquid drained from the distribution chamber(s) outside the mining shaft in the situation that the front of the train of segments for high wall mining makes a downward angle with the horizontal. The pump(s) need to be able to remove the liquid up to the required level in such a situation.

An embodiment of the invention further provides a high wall mining apparatus, comprising a train of conveyor segments for high wall mining, wherein the apparatus also comprises a launching platform for driving the train including a hose reel for holding the flexible feed. In addition it is advantageous to provide the hose reel with a control for controlling the cutter head and the pump, for receiving signals from the fluid level sensor, etcetera.

In an embodiment of the invention, the high wall mining apparatus comprises a typical compact reel driving element and tensioning means for controlled driving the hose reel, for delivering and taking up the feed. The reel driving element and tensioning means are required to roll and unroll the correct length of flexible feed which also prevents damage for example as a result of high loads on the feed. For correct positioning the feed onto the reel, the reel comprises a spooling element. During assembling of the segments, the segments are pushed forward into the mine shaft and high tensile stresses in the feed have to be prevented. Using a driving element for unrolling the feed from the hose reel decreases the tensile stresses and thereby decreases the risk of damage to the feed.

An embodiment of the invention moreover provides a method for high wall mining, using an high wall mining apparatus, comprising: the in succession coupling of a number of segments to form a train of segments connecting to a cutter head for high wall mining, the driving of the cutter head, the transportation of mined material from the cutter head by the train of segments towards the entrance of the mine shaft, wherein fluid is transported through the flexible feed, the second and first fluid transporters and the distribution chamber. The advantages of the method for high wall mining correspond to the advantages as described above in relation to the assembly of the cutter head segment and the pump segment.

During mining, the fluid may be transported away from the cutter head towards the entrance of the mining shaft. In case of the release of unwanted gases, such as explosive gases, towards the direct mining area near or at the cutter head, neutralization gases may be transported through the first fluid transporter. In case a fluid transporter is clogged, a reversed fluid flow may be used for unclogging. In an embodiment of the method fluid is transported out of the mine shaft, which transport direction may be reversed. Unclogging may be realised by at least temporarily reversing the transport direction of the fluid towards the cutter head. In addition, the fluid flow towards the cutter head segment may be used for cooling the cutter head, in particular the bits of the cutter head. Moreover, the fluid flow towards the cutter head segment may be used to precipitate and/or remove explosive dust, which may arise during mining. An alternative is that the apparatus according to an embodiment of the invention is used in combination with an additional liquid feed (for cooling and/or dust removal); the apparatus according the invention provides in such a case freedom in the use of the fluid feed; even larger liquid flows may be used for cooling and/or dust removal as the liquid excess can be removed with the present invention.

In a specific application of the method it comprises detecting the fluid level at the cutter head wherein the steering of the pump is dependent of the detected fluid level. This enables efficient mining, as fluid is transported away from the cutter head if the fluid level exceeds a predetermined level.

BRIEF DESCRIPTION OF THE DRAWINGS

The present invention will be further elucidated with reference to the non-limitative embodiments shown in the following figures. Herein.

DETAILED DESCRIPTION

Figure 1:
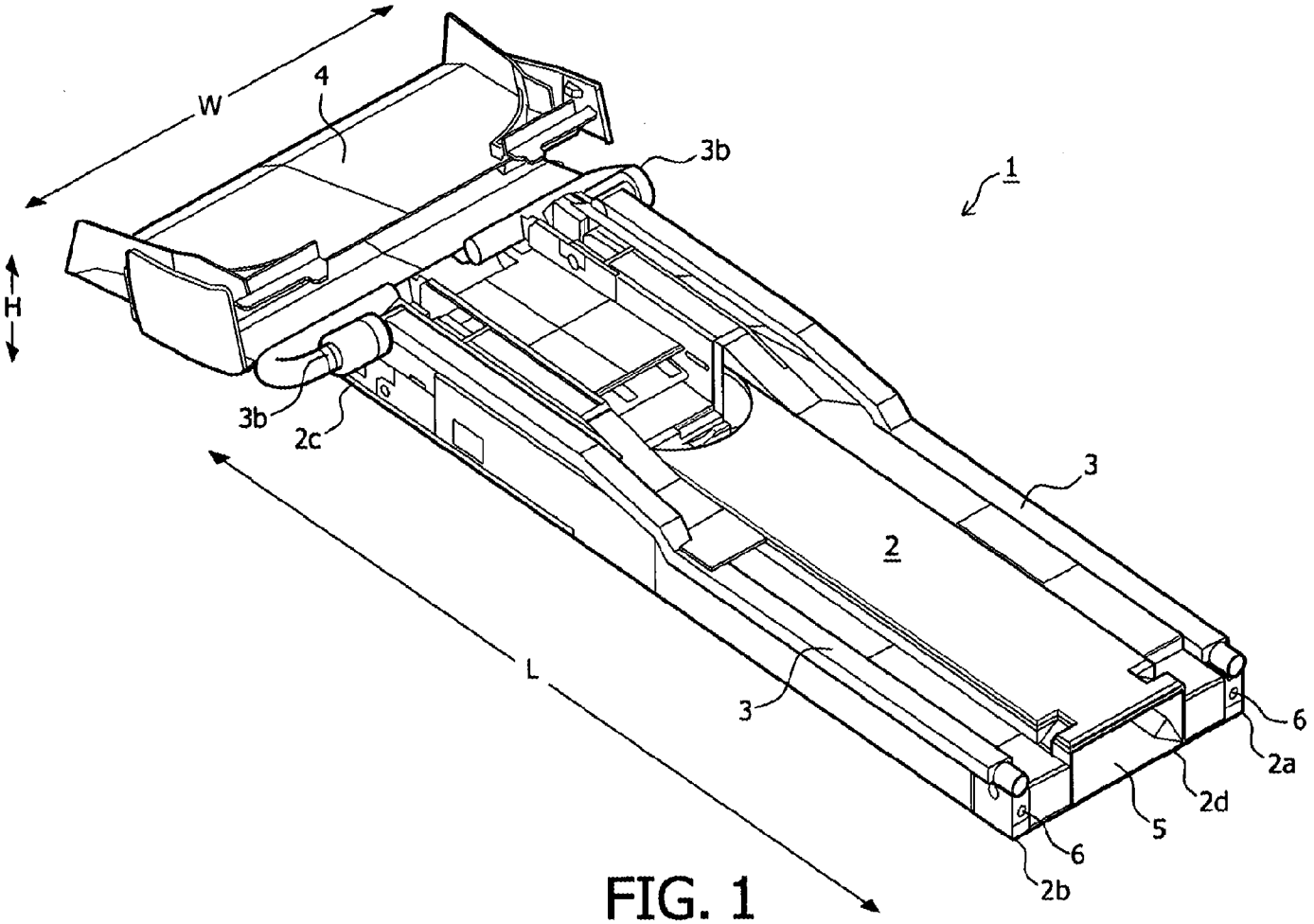
FIG. 1 shows a perspective view of a cutter head segment according to an embodiment of the invention.

FIG. 1 shows a cutter head segment 1 according to an embodiment of the invention for use at the front of a train of conveyor segments for high wall mining. The cutter head segment 1 comprises a frame 2, having a length L, width W and height H. Along longitudinal sides 2*a*, 2*b* of the frame 2 a first fluid transporter 3 is situated, which is embodied as pipes with (in this embodiment) a hollow rectangular cross section and made out of steel. First end parts 3*a* (see FIG. 2) of the first fluid transporter 3 are connected by hinges 3*b* to longitudinal parts of the first fluid transporter 3 near a front side 2*c* of the frame 2. A pan 4 (comprising an equipment chamber) is connected to the first end part 3*a* (see FIG. 2) of the fluid transporter 3, which pan 4 functions as a holder for equipment and for streaming the mined material away from a cutter head (not shown) of the cutter head segment. As a result, when the pan 4 swivels relative to the frame 2 the end parts 3*a* of the first fluid transporter 3 allow for movement of parts of the first fluid transporter 3 to follow the relative movements of the pan 4. The frame 2 also comprises a transport channel 5, for transporting mined material to a subsequent segment of a train of conveyor segments (not shown in this figure) for high wall mining. The frame 2 comprises a coupling 6 at a rear side 2*d* opposite to the front side 2*c* of the cutter head segment 1, for coupling a subsequent segment with the cutter head segment 1. The first fluid transporter 3 is designed such that it fits within the width W and height H of the cutter head segment 1 (see also FIG. 6) allowing easy movement of the cutter head segment 1 in the mining shaft.

Figure 2:
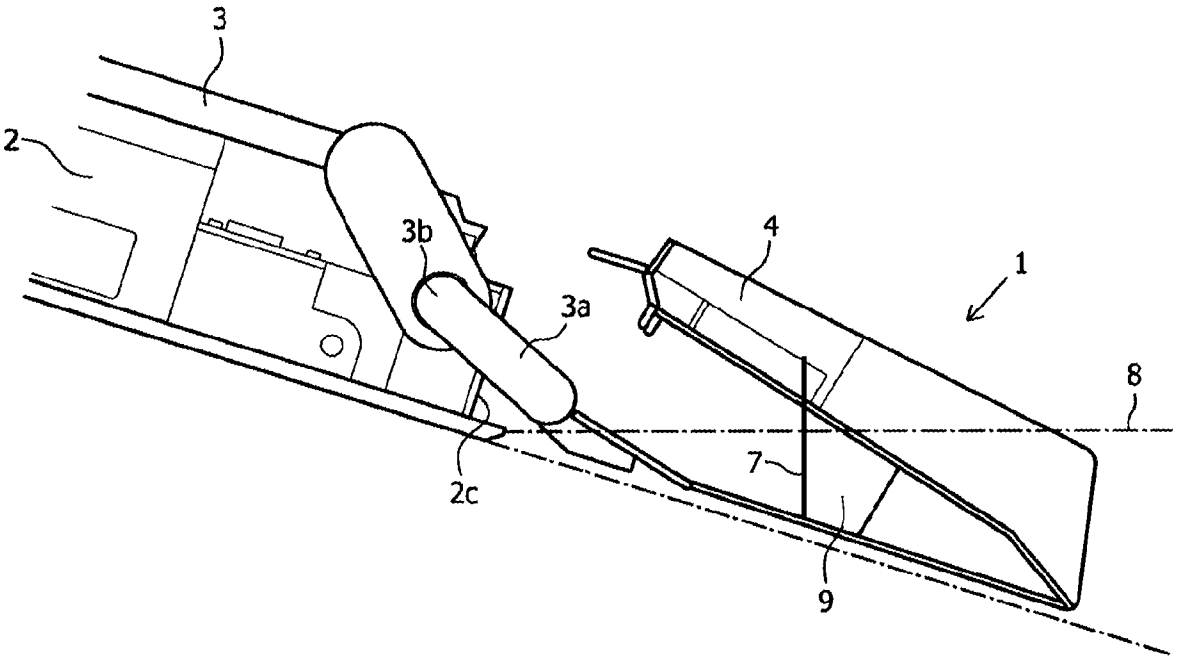
FIG. 2 shows a detailed side view of the cutter head segment of FIG. 1.

FIG. 2 shows a detailed side view of the cutter head segment 1 already shown in FIG. 1 near the front side 2*c* of the frame 2, wherein the cutter head segment 1 slopes downward. The cutter head segment 1 comprises a fluid sensor 7 positioned in or near the equipment chamber of the pan 4, schematically shown by the vertical lines, for detecting a fluid level 8.

Figure 3:
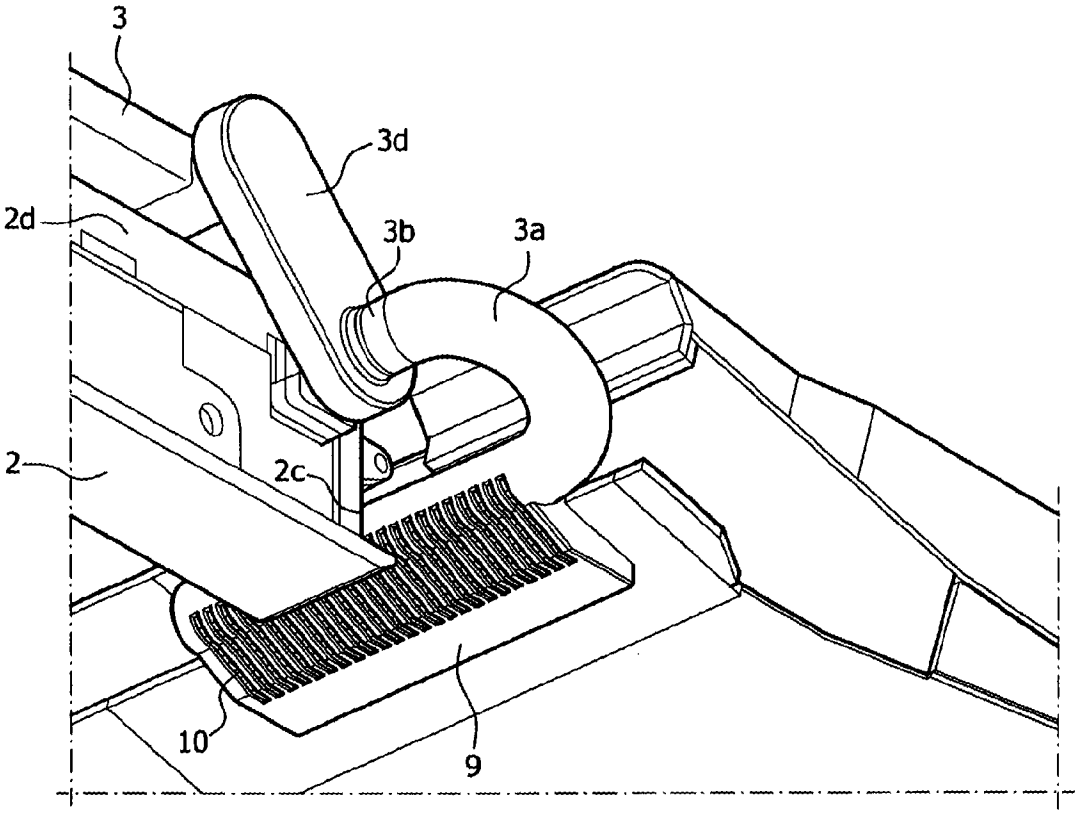
FIG. 3 shows a perspective detail view of the cutter head segment of FIG. 1.

FIG. 3 shows a perspective detail view of the cutter head segment 1. The first end part 3*a* comprises a fluid distribution chamber 9, which is in open connection with the first fluid transporter 3. The fluid distribution chamber 9 extends in the width of the cutter head segment 1 and provides for a large capacity of fluid exchange with the environment. A strainer 10 is positioned at the front of an opening of the fluid distribution chamber 9, to prevent larger objects from entering the first fluid transporter 3.

Figure 4:
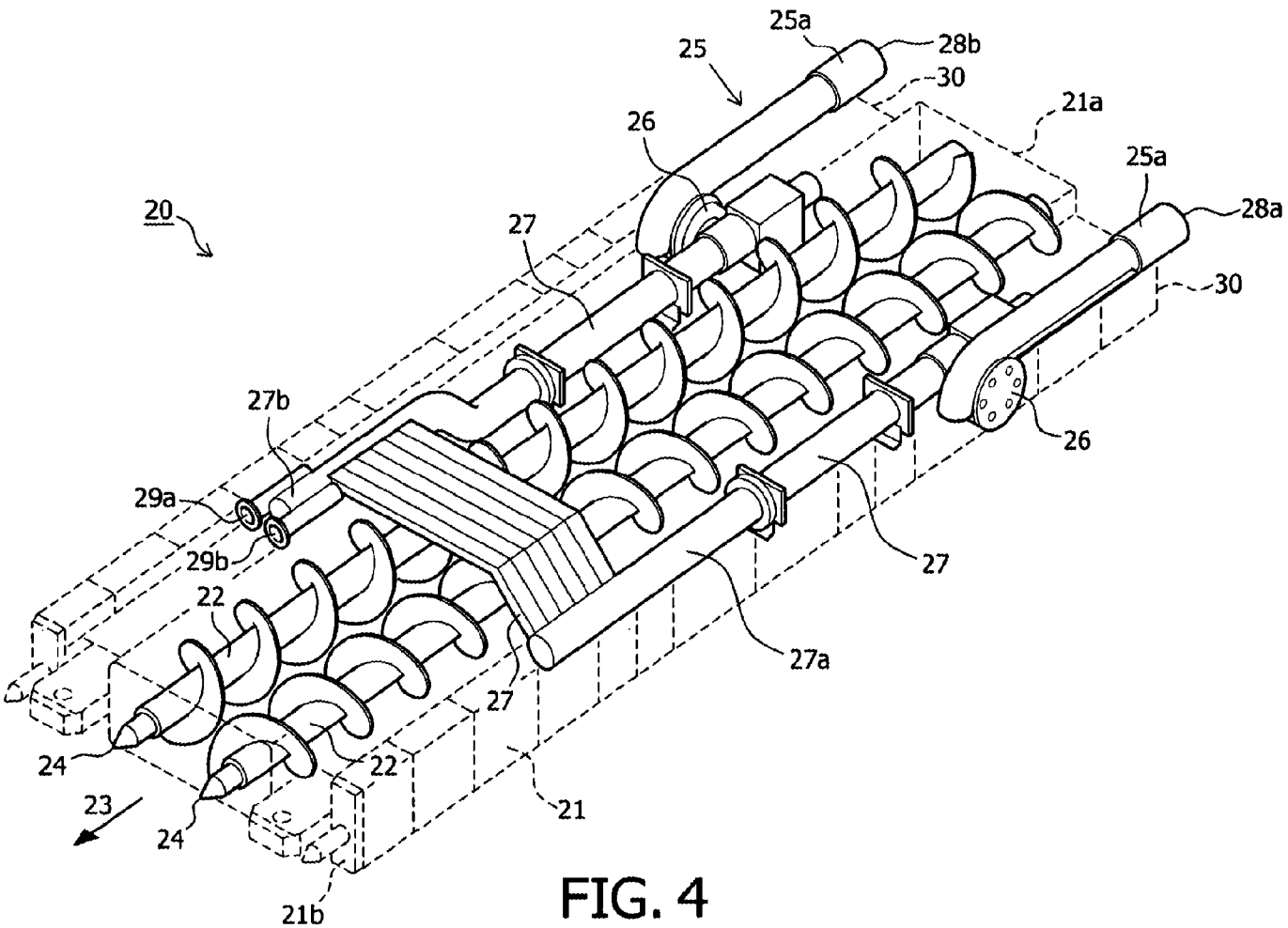
FIG. 4 shows a partially cut away perspective view of a pump segment according to an embodiment of the invention.

FIG. 4 shows a pump segment 20 according to an embodiment of the invention. The pump segment 20 comprises a housing 21 wherein two co-operating screw conveyors 22 are located for transporting mined material to opposite sides of the pump segment 20. The top of the housing 21 is omitted for clarity. The housing 21 is partly opened at opposite short sides, to allow mined material to pass from and/or to adjacent segments. The screw conveyors 22 comprise connectors 24 at a first short edge 21*a* of the housing 21 for attachment of the screw conveyors 22 to screw conveyors of an adjacent conveyor segment. The pump segment 20 comprises a second fluid transporter 25, of which the ends 25*a* are connectable with the first fluid transporter 3 of a cutter head segment 1 as shown in the FIGS. 1 and 2. The pump segment 20 comprises two two-directional cavity pumps 26, provided with a driver (not shown) for driving fluid through the second fluid transporter 25. The pumps 26 and their drivers are enclosed in the housing 21, to prevent damage to the pumps 26 and their drivers, for example by handling of the pump segment 20 and/or impact by surrounding objects such as debris or mined material. The second fluid transporter 25 comprises two separate passages 27 that start at the first short edge 21*a* of the pump segment 20, at which side the passages 27 are provided with two spaced apart front connectors 28*a*, 28*b*.

Figure 5:
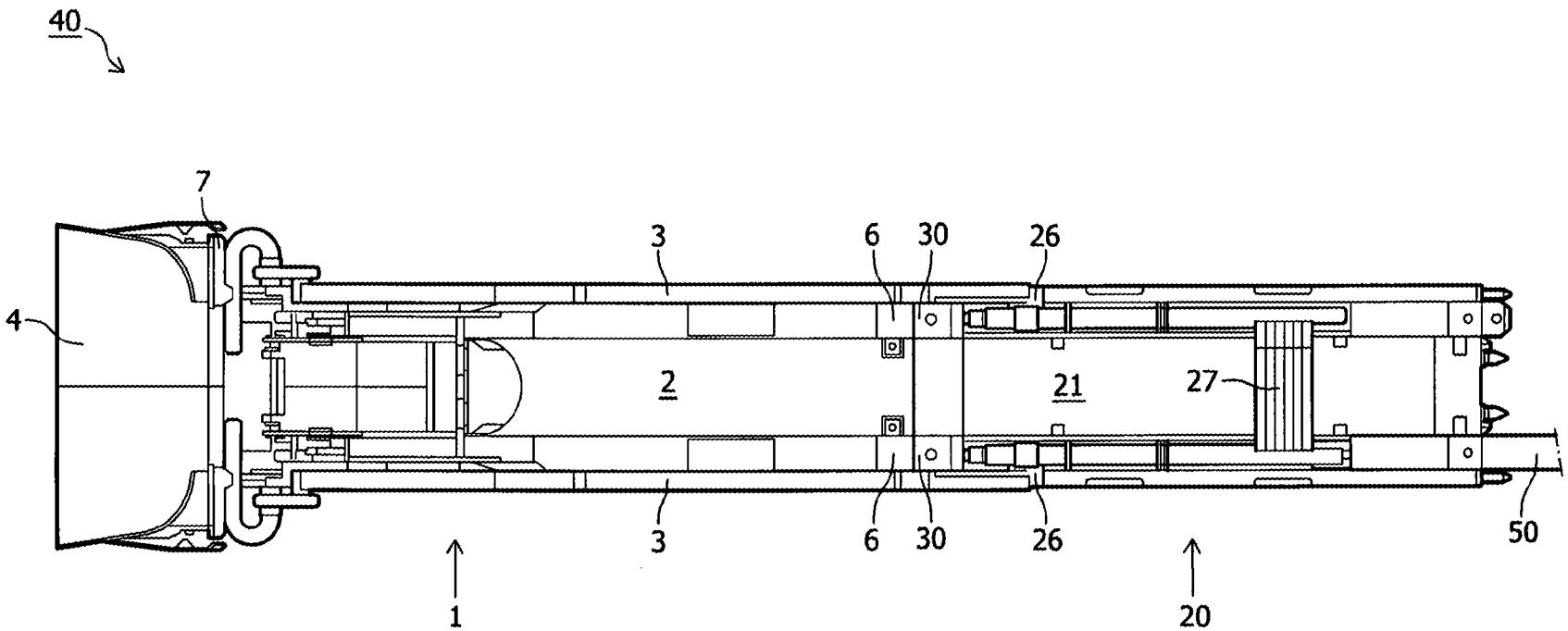
FIG. 5 shows a top view of an assembly of the cutter head segment of FIG. 1 and the pump segment of FIG. 4.

At the opposite short edge 21*b* of the pump segment 20, the passages 27 are provided with two rear connectors 29*a*,29*b* at a smaller distance than the front connectors 28*a*,28*b* (see FIG. 5). One of the passages 27 at a longitudinal side comprises a fly over, for transferring a fluid flow in that passage 27 to an opposite longitudinal side of the pump segment 20. The rear connector 29*b* is positioned next to the rear connector 29*a*. As a result, fluid flow through the separate passages of the first fluid transporter 3 of the cutter head segment 1 result in separate fluid flows through the passages 27. The pump segment 20 is designed and dimensioned to be coupled with the cutter head segment 1 according to the invention and prior art cutter head segments as well as prior art conveyor segments as described above in relation to the train of conveyor segments for high wall mining. The housing 21 comprises a coupling 30 at opposite short edges 21*a* and 21*b*, for coupling the pump segment 20 to an adjacent segment, such as the cutter head segment 1. In addition the pump segment 20 is designed and dimensioned that it can be handled by a launching platform for the in succession coupling of a number of conveyor segments to form a train of conveyor segments, such as disclosed in WO 2006/052123.

Figure 6:
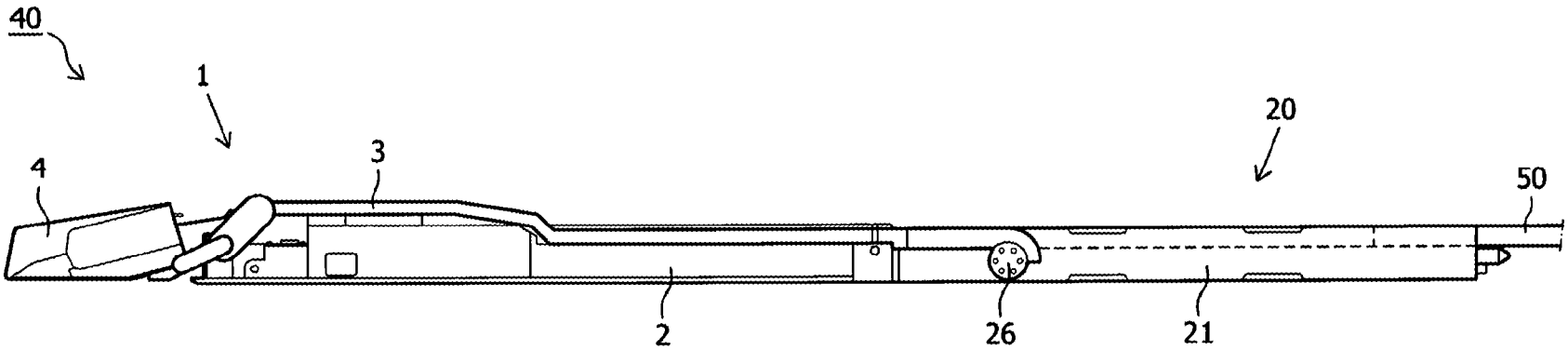
FIG. 6 shows a side view of the assembly of FIG. 5.

FIG. 5 shows an assembly 40 of the cutter head segment 1 of FIG. 1 and the pump segment 20 of FIG. 3. The cutter head segment 1 and the pump segment 20 are coupled by couplings 6 of the cutter head segment 1 and coupling 30 of the pump segment 20. Additionally, a flexible feed 50 is coupled with the rear connectors 29*a*, 29*b* of the passages 27 of the second fluid transporter 25 of the pump segment 20. The first fluid transporter 3 also comprises a communication line (not shown) between the fluid sensor 7 and the pumps 26. The assembly 40 is provided with a steering, for activating the pumps 26, depending on the signal of the fluid sensor 7. In the situation that the fluid sensor 7 detects that the liquid level exceeds a predetermined level, it will provide a signal to the steering, which will activate the pumps 26. FIG. 6 shows a side view of the assembly 40 shown in FIG. 5.

Figure 7:
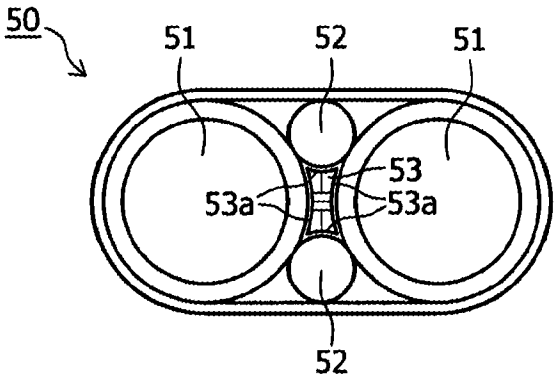
FIG. 7 shows a cross sectional view of a feed according to an embodiment of the invention.

FIG. 7 shows a cross sectional view of the flexible feed 50. The flexible feed 50 comprises two tubes 51, made from high-density polyethylene and two hoses 52 for providing hydraulic power to the cutter head 1 and the pump segment 20. The tubes 51 and the hoses 52 are positioned around composite centralisers 53, which centralisers 53 are positioned at predetermined distances along the length of the flexible feed 50 and have concave sides 53*a*, for receiving the convex outer walls of the tubes 51 and the hoses 52. Around the tubes 51 and the hoses 52 shrink sleeves are positioned at predetermined distances along the length of the flexible feed 50.

Figure 8:
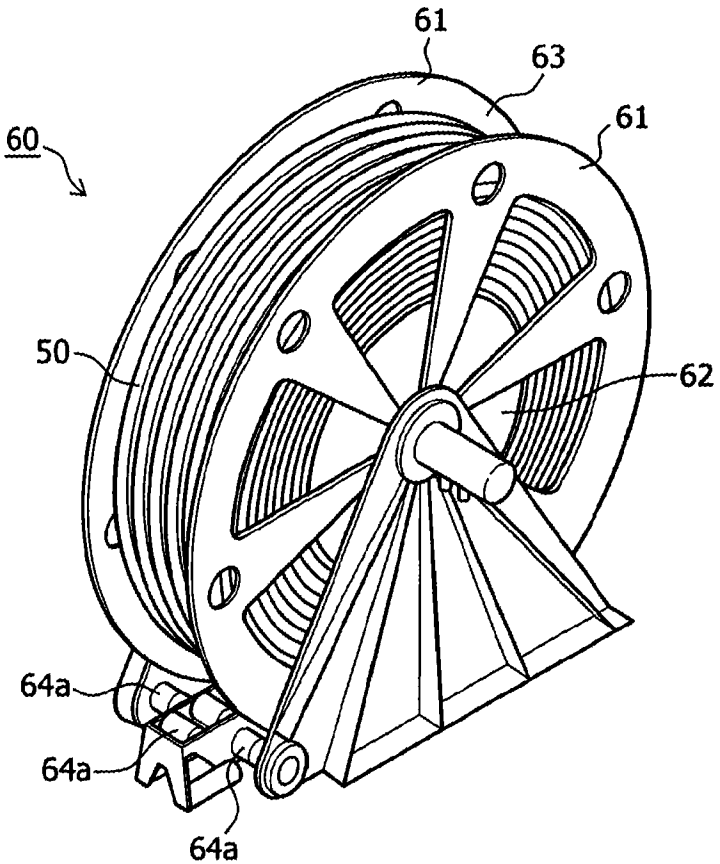
FIG. 8 shows a hose reel of an apparatus for high wall mining according to an embodiment of the invention.

FIG. 8 shows a hose reel 60 of an apparatus for high wall mining according to an embodiment of the invention. The hose reel 60 comprises two flanges 61, spaced apart and connected to a circumferential wall 62. The flanges 61 and the outer side of the circumferential wall 62 form a receiving space 63 for receiving the flexible feed 50. The diameter of the outer edge of the flanges 61 is 4.7 meter and the diameter of the circumferential wall 62 is 2.2 meter. The hose reel 60 comprises a driving element 64 for delivering and/or taking up, as well as for both hydraulic and mechanical safe brake hold, the at least one flexible feed 50 to the hose reel 60. The mechanical driving element 64 comprises rollers 64*a*, a synchronic spindle-spool with pitch loop (endless screw stroke) driven by sprockets and chain or by hydraulics. The driving element 64 can activate the rollers in two directions, for delivering or taking up the flexible feed 50. The hose reel 60 also comprises a spooling device (not shown) for guiding the feed 50 over the reel 60 during delivering and/or taking up of the feed 50. The spooling device comprises a driving arm, which moves in alternating directions along the complete effective width (between the flanges 61) of the reel 60 for each subsequent layer of the feed 50 on the reel 60. The spooling device is preferably mechanical. The hose reel 60 further comprises on the opposite side of the drive a charge and/or discharge unit that may be embodied as a multi channel fluid corrosion resistant steel swivel integrated in the hose reel bearing shaft which may also be multiple extended with a signal and or power slipring per core. The apparatus for high wall mining also comprises a control unit which comprises signal lines for steering the pumps 26 and for receiving signals from the fluid sensor 7, which signals from the fluid sensor 7 may be used for steering the pumps 26 as well as for statistical purposes.

The invention claimed is:

1. A cutter head segment for use at the front of a train of conveyor segments for high wall mining, comprising:

a frame;

a front side of the frame configured to support at least one cutter head;

at least one coupling element, connected to the frame at a backside opposite to the front side, for coupling the cutter head segment with a subsequent segment of the train of conveyor segments; and at least one first fluid transporter connecting to at least one fluid distribution chamber, wherein the distribution chamber is opened to the environment, and wherein the first fluid transporter includes two passages that run along opposite longitudinal sides of the frame.

2. The cutter head segment as claimed in claim 1, wherein the fluid distribution chamber is opened to the environment with an intermediate strainer, for preventing objects greater than a predetermined size entering the fluid transporter.

3. The cutter head segment as claimed in claim 1, wherein the cutter head segment comprises an equipment chamber, and the distribution chamber is located below the equipment chamber.

4. The cutter head segment as claimed in claim 1, wherein the first fluid transporter is provided with at least one flexible coupling.

5. The cutter head segment as claimed in claim 1, wherein the cutter head segment comprises a sensor for detecting a fluid.

6. A pump segment for use in a train of conveyor segments for high wall mining, the pump segment comprising:

a housing;

at least one conveyor connected to the housing for transporting mined material between opposite sides of the pump segment;

a fluid transporter connected to the housing and having two fluidly separate passages configured to transport fluid from a first side to an opposite second side of the pump segment, incorporating at least one pump, and wherein the fluid transporter is fluidly separate from the at least one conveyor; and at least one front connector and at least one rear connector for connecting the fluid transporter to adjacent fluid transporters.

7. The pump segment as claimed in claim 6, wherein the pump is two-directional.

8. The pump segment as claimed in claim 6, wherein the pump is a cavity pump.

9. The pump segment as claimed in claim 6, wherein the passages at the first side are provided with two spaced apart front connectors, and at the second opposite side with two rear connectors spaced apart a smaller distance than the front connectors.

10. The pump segment as claimed in claim 9, wherein one of the passages is provided with a fly-over to divert that passage from one longitudinal side of the pump segment to the opposite longitudinal side.

11. The pump segment as claimed in claim 6, wherein the at least one rear connector, also comprises at least one data connector for coupling a signal line.

12. An assembly, comprising:

a cutter head segment, comprising at least one first fluid transporter connecting to at least one fluid distribution chamber, wherein the fluid distribution chamber is opened to the environment; and a pump segment coupled with the cutter head segment, the pump segment comprising:

a housing;

at least one conveyor connected to the housing for transporting mined material between opposite sides of the pump segment;

a second fluid transporter connected to the housing and having two fluidly separate passages configured to transport fluid from a first side to an opposite second side of the pump segment, incorporating at least one pump; and front connectors coupled to a first end of the passages and fluidly connecting the second fluid transporter to the first fluid transporter at the first side of the pump segment.

13. The assembly according to claim 12, wherein the cutter head segment comprises a fluid sensor that is communicating with the pump, for providing a signal to the pump based on a fluid level within the cutter head segment.

14. A train of conveyor segments for high wall mining, comprising an assembly as claimed in claim 12 and a number of conveyor segments, coupled subsequent to the pump segment.

15. The train of segments for high wall mining, according to claim 14, the train comprises a flexible feed connecting to the rear connector of the second fluid transporter.

16. A high wall mining apparatus, comprising a train as claimed in claim 15 wherein the apparatus also comprises a launching platform for driving the train including a hose reel for holding the flexible feed.

17. The high wall mining apparatus as claimed in claim 16, wherein the apparatus comprises a driving element and tensioning means for controlled driving and safe holding the hose reel.

18. A method for high wall mining, using an apparatus as claimed in claim 16, comprising:

coupling a number of segments in succession to form a train of segments connecting to a cutter head for high wall mining, driving the cutter head, transporting mined material from the cutter head by the train of segments towards the entrance of the mine shaft, wherein fluid is transported through the flexible feed, the second and first fluid transporters and the distribution chamber.

19. The method as claimed in claim 18, wherein fluid is transported towards the entrance of the mine shaft, which transport is at least temporarily reversed into fluid transport in the direction to the cutter head.

20. The method as claimed in claim 18, wherein the method comprises detecting fluid at the cutter head and wherein the fluid is transported based on the detected fluid.

* * * * *